US010286980B2

(12) United States Patent
Monk et al.

(10) Patent No.: US 10,286,980 B2
(45) Date of Patent: May 14, 2019

(54) CONTROL OF MULTI-HULLED VESSELS

(71) Applicant: NAUTI-CRAFT PTY LTD, Dunsborough, Western Australia (AU)

(72) Inventors: Richard Monk, Yalyalup (AU); Michael Longman, Dunsborough (AU); Anthony Christopher Livanos, Yallingup (AU)

(73) Assignee: Nauti-Craft Pty Ltd, Dunsborough, Western Australia (AU)

( * ) Notice: Subject to any disclaimer, the term of this patent is extended or adjusted under 35 U.S.C. 154(b) by 79 days.

(21) Appl. No.: 15/310,954

(22) PCT Filed: May 15, 2015

(86) PCT No.: PCT/AU2015/000287
§ 371 (c)(1),
(2) Date: Nov. 14, 2016

(87) PCT Pub. No.: WO2015/172188
PCT Pub. Date: Nov. 19, 2015

(65) Prior Publication Data

US 2017/0088235 A1 Mar. 30, 2017

(30) Foreign Application Priority Data

May 16, 2014 (AU) ..... 2014901832
Jun. 10, 2014 (AU) ..... 2014902211
Mar. 5, 2015 (AU) ..... 2015900786

(51) Int. Cl.
*B63B 1/14* (2006.01)
*B63B 27/14* (2006.01)
(Continued)

(52) U.S. Cl.
CPC ..... *B63B 1/14* (2013.01); *B63B 27/14* (2013.01); *B63B 27/30* (2013.01); *B63B 39/00* (2013.01);
(Continued)

(58) Field of Classification Search
CPC ..... B63B 1/14; B63B 27/14; B63B 27/30; B63B 39/00; B63B 39/04; B63B 39/06;
(Continued)

(56) References Cited

U.S. PATENT DOCUMENTS 3,156,209 A * 11/1964 Ask ..... B63B 1/286 114/275
3,395,667 A * 8/1968 Kohman ..... B63B 39/06 114/122
(Continued)

FOREIGN PATENT DOCUMENTS

GB 2425189 10/2006
WO 9836923 8/1998
(Continued)

OTHER PUBLICATIONS

European Search Report for Application No. 15792828.4 dated Dec. 1, 2017 (8 pages).
(Continued)

*Primary Examiner* — Thomas G Black
*Assistant Examiner* — Sze-Hon Kong
(74) *Attorney, Agent, or Firm* — Michael Best & Friedrich LLP

(57) ABSTRACT

A vessel is disclosed having a body portion that is at least partially suspended above at least one left moveable hull and at least one right moveable hull, each hull being moveable with respect to the body portion. At least one sensor is arranged to sense at least one operational parameter of the vessel. The roll attitude of the body portion is adjustable and
(Continued)

controlled during operation in response to the at least one operational parameter to ensure that the sum of the gravitational force and the centrifugal force acting on the vessel during a turn has a line of action that is substantially perpendicular to a deck of the vessel, i.e. that the vessel executes a coordinated turn.

28 Claims, 8 Drawing Sheets

(51) Int. Cl.
*B63B 27/30* (2006.01)
*B63B 39/00* (2006.01)
*B63B 39/06* (2006.01)
*B63B 39/04* (2006.01)
*B63B 17/00* (2006.01)

(52) U.S. Cl.
CPC ..... *B63B 39/04* (2013.01); *B63B 39/06* (2013.01); *B63B 2001/145* (2013.01); *B63B 2017/0072* (2013.01)

(58) Field of Classification Search
CPC ..... B63B 2001/145; B63B 2017/0072; B63B 1/121; B63B 1/32
See application file for complete search history.

(56) References Cited

U.S. PATENT DOCUMENTS 3,469,550 A * 9/1969 Priestley ..... B63B 1/286 114/275
3,517,632 A * 6/1970 Gray ..... B63B 1/22 114/283
3,715,571 A * 2/1973 Braddon ..... B63H 25/24 114/144 R
3,886,884 A * 6/1975 Stark ..... B63B 1/286 114/275
3,998,176 A * 12/1976 Stout ..... B63B 1/22 114/283
4,182,256 A * 1/1980 Scott ..... B63B 1/286 114/276
4,763,596 A * 8/1988 Yoshida ..... B63B 1/107 114/256
4,817,550 A * 4/1989 Gutsche ..... B62D 37/04 114/124
5,237,947 A * 8/1993 Manning ..... B63B 1/14 114/125
5,390,623 A * 2/1995 Mackaness ..... B63B 1/22 114/282
5,433,161 A * 7/1995 Loui ..... B63B 1/107 114/265
5,469,801 A * 11/1995 Payne ..... B63B 1/28 114/274
5,592,895 A * 1/1997 Schmidt ..... B63B 1/107 114/274
5,918,562 A * 7/1999 Macchio ..... B63B 1/20 114/61.29
5,988,097 A * 11/1999 Karney ..... B63B 1/22 114/283
6,164,401 A * 12/2000 Vollmerhausen ..... B60V 1/08 180/119
6,176,190 B1 * 1/2001 Ozga ..... B63B 1/14 114/272
7,562,633 B2 * 7/2009 Conti ..... B63B 1/14 114/61.1
7,913,636 B2 * 3/2011 Meyer ..... B63B 1/22 114/279
8,145,370 B2 * 3/2012 Borrett ..... B63H 25/02 701/21
8,347,802 B2 * 1/2013 Pereira ..... B63H 25/50 114/55.54
8,583,300 B2 * 11/2013 Oehlgrien ..... B63B 39/061 114/275
8,626,365 B2 * 1/2014 Shimo ..... G05D 1/0206 114/144 RE
9,452,808 B1 * 9/2016 Oklejas, Jr. ..... B63B 1/14
2003/0154896 A1 * 8/2003 Schmidt ..... B63B 1/107 114/61.12
2005/0011427 A1 * 1/2005 Schmitz, Sr. ..... B63B 39/06 114/162
2007/0066156 A1 * 3/2007 Mizutani ..... B63H 20/12 440/59
2008/0258416 A1 * 10/2008 Wilcox ..... B60G 3/01 280/124.103
2010/0138084 A1 * 6/2010 Pereira ..... B63B 35/731 701/21
2011/0048306 A1 * 3/2011 Zvenyhorodskyy .... B63B 39/06 114/39.24
2013/0068151 A1 * 3/2013 Heyring ..... B63B 1/14 114/61.15
2013/0213288 A1 8/2013 Hall

FOREIGN PATENT DOCUMENTS

WO 2004016497 2/2004
WO 2011143692 11/2011
WO 2013181699 A1 12/2013

OTHER PUBLICATIONS

International Search Report and Written Opinion for Application No. PCT/AU2015/000287 dated Jun. 15, 2015 (9 pages).

* cited by examiner

CONTROL OF MULTI-HULLED VESSELS

TECHNICAL FIELD

The present invention relates to roll of marine vessels and specifically relates to controlling the roll angle of a body portion of a vessel.

BACKGROUND

Controlling the roll angle of an aircraft during a turn such that the resultant force (comprising a vertical gravitational force and a centrifugal force) remains perpendicular to the floor of the cabin is known as making a coordinated turn. This is particularly important for passenger comfort as the weight of a person remains acting downwards relative to the person and relative to their seat, and any drink on a table appears level. Although the weight of the person increases slightly, they do not feel a lateral force.

A coordinated turn strategy for roll control has been applied to mono-hull boats using interceptors as disclosed in International Publication Number WO2011/099931 to overcome roll or heeling issues with propulsion pod marine vessels. Similarly it has been proposed for stability reasons to apply a coordinated turn strategy for roll control of a hybrid craft comprising a mono-hull connected under a small aircraft as disclosed in International Publication Number WO91/12172.

In the applicant's International Publication Numbers WO2011/143692 and WO2011/143694 are disclosed multi-hull vessels comprising suspension. The hulls are moveable relative to the deck or body portion and active (powered) control of the roll attitude of the body relative to the hulls is discussed. U.S. Pat. No. 3,517,632 also discloses a multi-hulled vessel in which the left hull and the right hull are moveable vertically relative to the body in dependence on steering angle to provide a lateral shift in the centre of mass of the body inwards towards the centre of the turn and also to tilt the hulls into the turn to enhance the steering effect without requiring a rudder. However controlling roll angle in dependence on steering angle without including a speed parameter does not vary roll angle in dependence on lateral acceleration, so does not provide a coordinated turn control.

In a conventional multi-hulled vessel such as a catamaran for example where the hulls are fixed relative to the deck or body portion, executing a coordinated turn requires the hull towards the inside of the turn to be moved downwards relative the water surface and the hull towards the outside of the turn to be moved upwards relative to the water surface. These changes in the displacement of the inner and outer hulls during a turn can provide significant hydrodynamic losses in efficiency and the inability to move the hulls relative to the body make executing a coordinated turn at planing speed impossible. Also the wider the spacing between the hulls, the smaller the range of possible controlled roll angles, so the lower the maximum lateral acceleration that can be compensated for through adjusting the vessel roll angle. For these reasons multi-hulled vessels of conventional construction, where the hulls are fixed, are generally unable to execute coordinated turns at speed.

SUMMARY OF INVENTION

The present invention provides in one aspect a vessel having a body portion that is at least partially suspended above at least two hulls which are moveable with respect to the body portion, at least one sensor arranged to sense at least one operational parameter of the vessel, roll attitude of the body portion being adjustable and controlled during operation in response to said at least one operational parameter to ensure that the sum of the gravitational force and the centrifugal (substantially lateral with respect to ground) force acting on the vessel during a turn has a line of action that is perpendicular to a deck of the vessel. The at least two moveable hulls may include at least one left moveable hull and at least one right moveable hull.

The at least one operational parameter may include at least one lateral acceleration parameter. The at least one lateral acceleration parameter may include a predicted lateral acceleration, being a function of steering angle and speed, since lateral acceleration oriented relative to ground is substantially proportional to steering angle multiplied by the square of the vessel speed. When the steering angle is changed, the function of steering angle and speed can be used to predict the lateral acceleration that the vessel is about to experience before the loads build up, allowing the roll adjustment to be made before or while the roll moment builds up with increasing lateral acceleration. This is able to thereby reduce or minimise the power required to control the roll attitude of the body while maintaining the sum of the gravitational and centrifugal forces substantially perpendicular to a deck or floor portion of the body portion. The power required to provide active control of the roll angle can be minimised through the mechanism of the lateral shift of the centre of mass providing a roll moment compensating for the roll moment caused by the centrifugal force of a turn. Alternatively, for example when the steering angle is steady state, the at least one lateral acceleration parameter may include a calculated lateral acceleration, being a function of steering angle and speed. The function is essentially the same, but now the calculated lateral acceleration should be an actual lateral acceleration rather than a predicted soon to happen lateral acceleration. This calculated lateral acceleration is similarly oriented relative to ground. Alternatively or additionally, the at least one lateral acceleration parameter may include a calculated lateral acceleration, being a function of suspension support forces, since the roll moment due to cornering generates a difference in left versus right support forces in the suspension system (i.e. a couple) which can be used to calculate the lateral acceleration on the vessel body. Alternatively or additionally, the at least one lateral acceleration parameter may include a calculated lateral acceleration, being an average of two vertically spaced lateral accelerations oriented horizontally with respect to the body. As the vertically spaced lateral accelerometers are oriented horizontally with respect to the body, in this case the calculated lateral acceleration is likewise oriented horizontally with respect to the body, so minimising the calculated lateral acceleration oriented relative to the body ensures that the sum of the gravitational force and the centrifugal force acting on the vessel during a turn has a line of action that is substantially perpendicular to a deck of the vessel, i.e. achieve a coordinated turn. Similarly if a single body mounted lateral accelerometer is used to measure lateral acceleration on the body in an orientation horizontal with respect to the body, i.e. parallel to the deck so it rotates with rotation of the body, then the measured lateral acceleration can be minimised to ensure that the body roll attitude is substantially consistent with a coordinated turn. Therefore, the at least one lateral acceleration parameter may include a measured lateral acceleration, being measured in a lateral direction oriented horizontally with respect to the body portion. Conversely if the lateral acceleration is measured oriented relative to ground, using for example a motion compensated (tri-axial) accelerometer, then the roll angle to achieve a coordinated turn can be calculated from that lateral acceleration and the vessel roll angle adjusted to suit. Therefore, the at least one lateral acceleration parameter may include a measured lateral acceleration, being measured in a lateral direction relative to ground In one or more forms of the present invention, the body portion may be entirely supported above said at least two moveable hulls. Alternatively, the body portion of vessel may include at least one further hull fixed to the body portion and providing partial support of the body portion relative to the water surface and/or the at least two moveable hulls may include at least one left hull and at least one right hull. The at least one left hull may be a single hull towards a left side of the vessel and the at least one right hull may be a single hull towards a right side of the vessel in which case the vessel can be a catamaran or trimaran. Alternatively, the at least one left hull may include a forward left hull and a rearward left hull and the at least one right hull may include a forward right hull and a rearward right hull, the forward and rearward left and right hulls can then be arranged in a rectangular configuration for example. Alternatively, the at least two hulls further include at least one forward hull and at least one rearward hull, the left, right, forward and rearward hulls being arranged in a diamond configuration for example.

In one or more forms of the present invention, the body portion may be entirely suspended above said at least two hulls which are individually moveable in a vertical direction relative to the body portion, but constrained from moving in a lateral direction relative to the body. In this case, such as when using trailing arms for example, the vertical (with respect to ground) component of the load on each hull may be maintained substantially constant during a steady state coordinated turn.

In one or more forms of the present invention, the body portion may be supported above the hulls by a suspension system including at least two fluid actuators that vary in length and fluid volume, at least one of said two fluid actuators may include a chamber being part of at least one left circuit having a left circuit fluid volume and at least one of said two fluid actuators may include a chamber being part of at least one right circuit having a right circuit fluid volume. The suspension system may further include a fluid control system including at least a pump to effectively or directly transfer fluid between the at least one left circuit and the at least one right circuit to thereby enable adjustment of the roll attitude of the vessel.

In one or more forms of the present invention, the control of the roll attitude of the body portion may include time or the at least one operational parameter may be time-averaged. For example, the rate of roll adjustment may be controlled, so that a step change in steering angle does not elicit an immediate step change in roll attitude, but instead the roll attitude is adjusted at a rate that the vessel could move at, or should move at as a maximum for comfort. Or the lateral acceleration from an accelerometer may be averaged over a period such as a tenth of a second, either in blocks of that period, or as a moving average.

The body portion may be supported above the hulls by a suspension system including multiple support devices. The control of the roll attitude of the body portion may use pressures within and/or loads upon at least one of said multiple support devices. This and/or any other function may be combined. The support devices may be the fluid actuators and/or mechanical springs for example. Additionally or alternatively, the roll attitude of the body portion may be controlled up to a roll attitude limit which is determined in dependence on at least one support device exceeding a predefined travel limit and/or pressure or load.

In one or more forms of the present invention, the roll attitude of the body portion may be controlled up to a roll attitude limit which is determined in dependence on hull displacement relative to the body portion (for example pitch and heave motions relative to the body portion) and/or a detected sea state.

According to another aspect of the present invention, there is provided a method of controlling the roll angle of a body portion of a vessel, the vessel further including at least two hulls moveable relative to the body portion, the body being at least partially supported above said at least two hulls, the method including the steps of measuring a lateral acceleration of the body portion and adjusting the roll angle of the body to minimise the measured lateral acceleration of the body portion, said lateral acceleration of the body portion being parallel to a deck of the body portion (not absolute). The method may further include the step of measuring the lateral acceleration of the body portion using at least one lateral accelerometer mounted to the body portion.

According to another aspect of the present invention, there is provided a method of controlling the roll angle of a body portion of a vessel, the vessel further including at least two hulls moveable relative to the body portion, the body being at least partially supported above said at least two hulls, the method including the steps of detecting at least one lateral acceleration parameter and adjusting the roll angle of the body using the at least one lateral acceleration parameter to maintain a roll angle that is substantially consistent with a coordinated turn.

According to another aspect of the present invention, there is provided a method of controlling the roll angle of a body portion of a vessel, the vessel further including at least two hulls moveable relative to the body portion, the body being at least partially supported above said at least two hulls, the method including the steps of detecting at least one lateral acceleration parameter and adjusting the roll angle of the body using the at least one lateral acceleration parameter to ensure that the line of action of the sum of the gravitational force and the centrifugal force acting on the vessel during a turn is perpendicular to a deck of the vessel.

In either of the above two methods the step of detecting at least one lateral acceleration parameter may further include the steps of measuring vessel operating parameters and calculating or predicting the turning forces on the body portion. The operating parameters may include vessel speed & steering angle.

According to another aspect of the present invention, there is provided a method of controlling the roll angle of a body portion of a vessel, the vessel further including at least one left hull and one right hull moveable relative to the body portion, the body portion being at least partially supported above said at least one left hull and one right hull, the method including the step of adjusting the roll angle of the body to ensure that at least a vertical component of the pressure loads on the at least one left hull is within 15% of the equivalent at least vertical component of the pressure loads on the at least one right hull. The lateral component of the pressure loads on each hull increases to react the centrifugal force during a turn, but if the vertical component of the pressure loads on each hull is maintained or the change in the time-averaged vertical component of the pressure loads on each hull due to the roll moment on the body portion is substantially compensated by a lateral load shift due to rolling of the body portion, then the speed of the vessel is typically much less reduced than if the load balance changes between the left and right hulls. So preferably the variation between the (preferably time averaged) vertical component of the pressure load on the at least one left hull is within 15%, but it may be less than 10% or less than 5% or less than 2% of the equivalent vertical component of the pressure loads on the at least one right hull. This approach can improve efficiency, but does not necessarily provide the occupants of the vessel body portion with the comfort of a perfectly coordinated turn.

The method may further include the step of estimating and/or measuring the lateral acceleration of the body portion using at least one lateral accelerometer mounted to the body portion. The step of estimating and/or measuring the lateral acceleration may include using at least one motion compensated lateral accelerometer mounted to the body portion. Alternatively or additionally, the step of estimating and/or measuring the lateral acceleration may include the steps of measuring speed and steering angle and the step of calculating lateral acceleration. This enables a balance to be chosen between efficiency and occupant comfort.

The method may further include the step of estimating and/or measuring at least one load on said at least one left hull and one right hull.

The vessel may further include a suspension system for supporting at least a portion of the body above or relative to the at least one left hull and one right hull, the method may further include the step of estimating or measuring at least one load on or at least one pressure in the suspension system. For example the load in a mount of a suspension device (such as a ram or a spring) can be measured, but if the suspension device is fluid filled such as an air spring or a hydraulic ram, the pressure of the fluid can be measured to calculate force on the suspension device.

According to another aspect of the present invention, there is provided a method of controlling the roll angle of a body portion of a vessel, the vessel further including at least one left hull and one right hull moveable relative to the body portion, the body portion being at least partially supported above said at least one left hull and one right hull, the method including the steps of determining the leeway angle with which the vessel is proceeding and adjusting the roll angle of the body portion using leeway angle.

The step of adjusting the roll angle of the body portion using leeway angle may include adjusting the roll angle of the body portion of the vessel in dependence on an estimate or measurement of lateral acceleration or centrifugal force (rather than steering angle and speed alone for example) when the leeway angle exceeds a preset magnitude to prevent for example a steering angle due to leeway from driving an unnecessary roll of the body portion. Additionally or alternatively a global positioning signal may be used to determine that the angle of the steering is due to leeway rather than turning.

Additionally or alternatively, the step of adjusting the roll angle of the body portion using leeway angle may include adjusting the roll angle of the body portion of the vessel to ensure that at least a vertical component of a load on the at least one left hull is within 15% of the equivalent at least vertical component of a load on the at least one right hull when the leeway angle exceeds a preset magnitude. The load may be for example a pressure load on the hull from the water, or a load in a support device in a suspension system between the body portion on the left and right hulls.

Additionally or alternatively, the step of adjusting the roll angle of the body portion using leeway angle may further include the steps of: estimating or measuring lateral acceleration or centrifugal force; and estimating or measuring at least one load on at least one of the at least one left hull and one right hull or measuring a load on or pressure in a suspension component between the body portion and at least one of the at least one left hull and one right hull.

The step of adjusting the roll angle of the body using leeway angle may include calculating a roll angle offset to reduce or remove any difference between a roll angle set point for a perfectly coordinated turn and a roll angle set point calculated using inputs influenced by the leeway angle. The magnitude of the roll angle offset may be decayed as a function of time, the function optionally including any of lateral g, speed, steering angle and/or at least one load on at least one hull or at least one suspension member between the body portion and a hull.

According to another aspect of the present invention, there is provided a method of controlling the roll angle of a body portion of a vessel, the vessel further including at least one left hull and one right hull moveable relative to the body portion, the body portion being at least partially supported above said at least one left hull and one right hull, the method including the steps of determining a magnitude of payload offset and adjusting the roll angle of the body using the magnitude of payload offset.

The step of adjusting the roll angle of the body using magnitude of payload offset may include adjusting the roll angle of the body portion of the vessel in dependence on an estimate or measurement of lateral acceleration or centrifugal force (rather than or instead of using steering angle and speed alone for example) when the payload offset exceeds a preset magnitude.

Additionally or alternatively, the step of adjusting the roll angle of the body using the magnitude of payload offset may include adjusting the roll angle of the body portion of the vessel to ensure that at least a vertical component of a pressure load on the at least one left hull is within 15% of the equivalent at least vertical component of a pressure load on the at least one right hull when the payload offset is less than a preset magnitude.

Additionally or alternatively, the step of adjusting the roll angle of the body using the magnitude of payload offset may further include using: an estimate or measurement of lateral acceleration or centrifugal force; and an estimate or measurement of at least one load on at least one of the at least one left hull and one right hull or a measurement of a load on or pressure in a suspension component between the body portion and at least one of the at least one left hull and one right hull.

The step of adjusting the roll angle of the body using the magnitude of payload offset may include calculating a roll angle offset to reduce or remove any difference between a roll angle set point for a perfectly coordinated turn and a roll angle set point calculated using inputs influenced by the magnitude of payload offset. The magnitude of the roll angle offset may be decayed as a function of time (the function optionally including any of lateral g, speed, steering angle and/or at least one load on at least one hull or at least one suspension member).

It will be convenient to further describe the invention by reference to the accompanying drawings which illustrate preferred aspects of the invention. Other embodiments of the invention are possible and consequently particularity of the accompanying drawings is not to be understood as superseding the generality of the preceding description of the invention.

DESCRIPTION OF EMBODIMENTS

Figure 1:
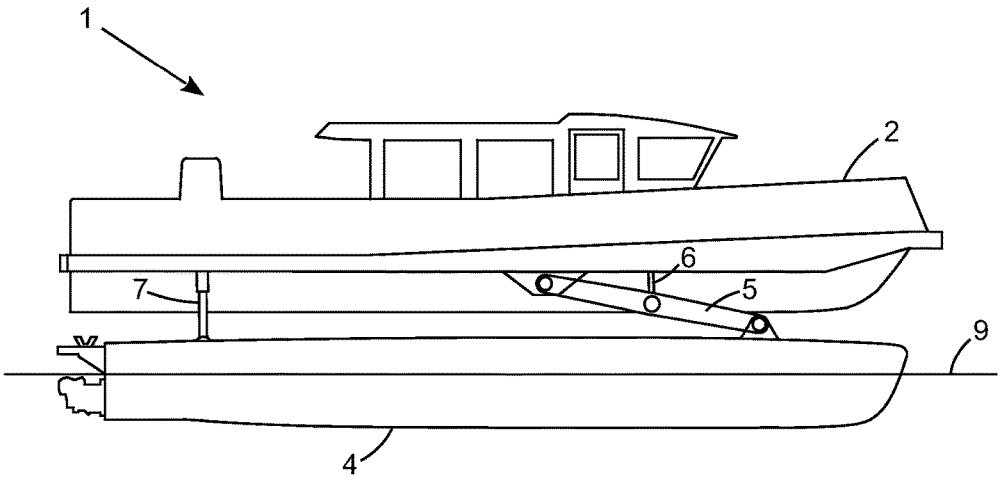
FIG. 1 is a side view of a multi-hulled vessel suitable for use with the present invention.

Referring initially to FIG. 1, there is shown a vessel 1 being a catamaran having a body 2 suspended above hulls (only the right hull 4 is visible in FIG. 1) by a suspension system including a front leading arm 5, a front support device such as a hydraulic actuator 6 and a rear sliding arm 7 within which is a rear support device. This suspension arm geometry permits the hulls to move vertically and to pitch relative to the body portion and independently of each other but constrains longitudinal motion and prevents lateral and individual roll motions of the hulls relative to the body portion, and is described in detail in International Publication Number WO 2013/181699, details of which are incorporated herein by reference. All of the above hull motions are described with respect to the body portion and throughout this specification, when a directional term is used and noted as being relative to the body portion, it generally means that the directions of the motion referenced are oriented in line with a reference frame that is aligned to the body portion. So vertical relative to the body portion should generally be interpreted as being perpendicular to the deck (assuming the deck is absolutely horizontal relative to the ground when the body portion is level) and lateral relative to the body portion should generally be interpreted as being parallel to the deck and perpendicular to a line running directly fore-aft (i.e. longitudinally) of the vessel. The waterline on the hulls is shown at 9.

Figure 2:
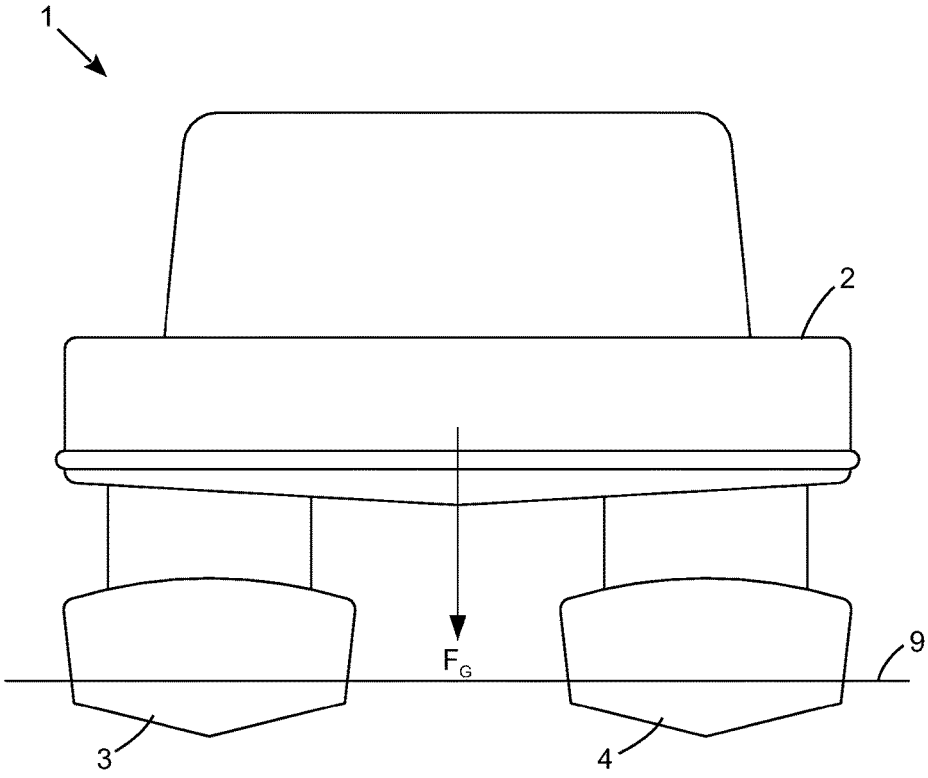
FIG. 2 is an end view of a vessel with no lateral acceleration.

FIG. 2 is a simplified rear view of a vessel with a body portion 2 supported above a left hull 3 and a right hull 4 by suspension such as that shown in FIG. 1. When the vessel is stationary in calm water, the only acceleration force acting on the centre of mass of the body portion 2 is gravity indicated by the arrow $F_G$. This is reacted by a portion of the vertical component of water forces generated by water pressure on the left and right hulls 3 and 4, the remainder of the vertical component of water forces reacting the weight of the hulls and unsprung parts of the suspension. If the body centre of mass is on the centre line of the body portion, and the hulls are mirrored about a vertical plane through the centreline of the body, then the vertical component of the water forces on the left and right hulls are equal.

Figure 3:
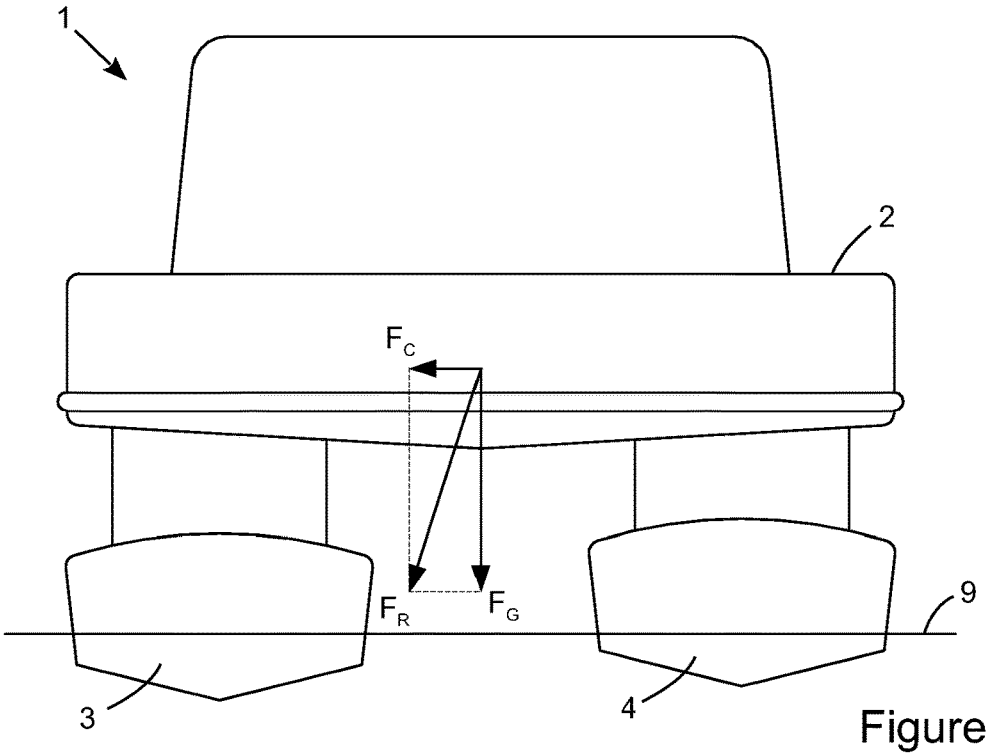
FIG. 3 is an end view of a vessel with controlled zero roll angle under lateral acceleration.

When the vessel 1 is under-way and makes a turn to the right, centrifugal force $F_C$ additionally then acts leftwards on the centre of mass of the body portion 2 as shown in FIG. 3. The resultant force $F_R$ acting on the body centre of mass comprises the gravitational component $F_G$ and the centrifugal component $F_C$. If the suspension system was resilient and no active roll attitude compensation was applied, the moment generated by the centrifugal force acting on the body portion would cause the body portion to roll to the left, causing the centre of mass to move towards the left. Such a lateral (in this case left-ward) displacement of the centre of mass would further increase the roll moment that must be reacted by the suspension system and ultimately the left and right hulls. However in FIG. 3 the body portion 2 is flat, i.e. an active roll attitude compensation has been applied to power the body back to a level roll attitude. As the body portion is level, not rolled, there has been no lateral shift of the centre of mass of the body portion. The roll moment generated by the centrifugal force $F_C$ acting on the body portion of the vessel is reacted by changes in the loads in the suspension system and ultimately by changes in loads on the hulls which has caused the left hull to increase in load and therefore displacement and the right hull to reduce in load and therefore displacement. So the left hull 3 is shown correspondingly lower in the water than the right hull 4. Also if the suspension geometry does not permit the hulls to roll relative to the body portion, then if the body portion is controlled to a substantially level (zero or low) roll attitude, the dead rise of the hulls is not able to roll the hulls and contribute to the cornering forces in the same manner as a monohull. As a result the wake off the hulls when turning is much more uneven between the left and right hulls than when travelling in a straight line and it is more difficult to remain at a constant planing speed while turning. Indeed the increase in displacement of the outer hull can be sufficient to ensure that the outer hull becomes unable to plane, so the entire vessel slows down and ceases planing. Although passenger comfort is improved during turns compared to using a passive suspension arrangement that allows the body portion to roll outwards during turns, passengers still feel a lateral acceleration due to the centrifugal force.

Figure 4:
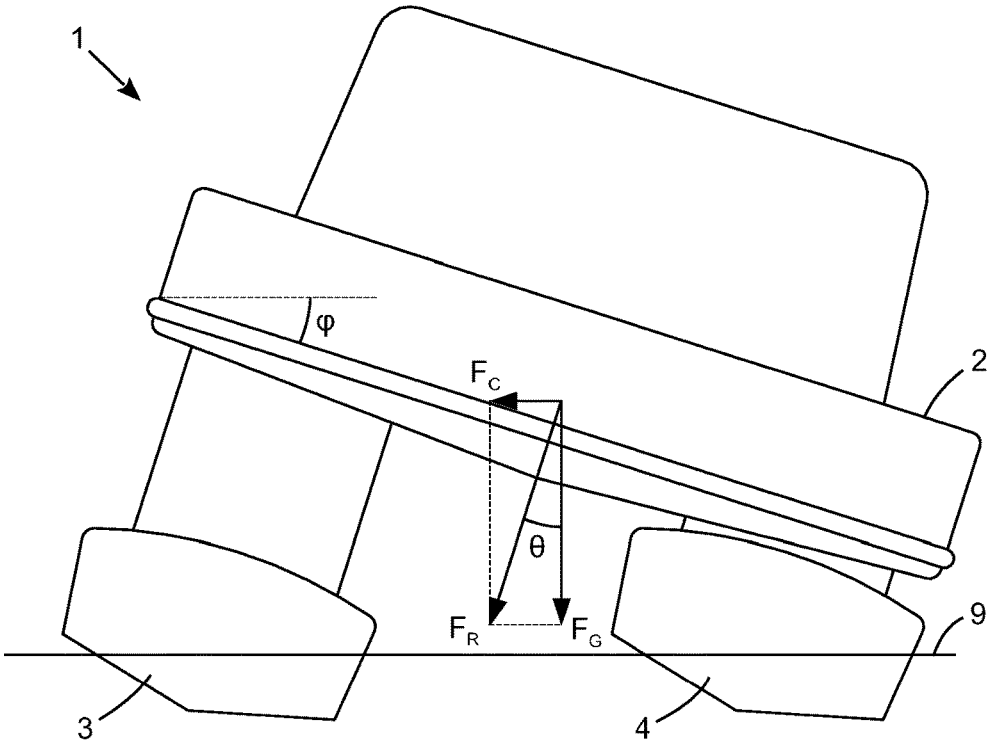
FIG. 4 is an end view of vessel with a coordinated turn roll angle according to an embodiment of the present invention.

FIG. 4 shows a vessel 1 rolling inwards while turning. In this particular example the magnitude of the inwards roll angle is very specific as it matches the criteria for making a coordinated turn. That is, the body portion 2 has been rolled into the turn by an angle $\varphi$ equal to the angle $\theta$ formed between the line of action of the resultant force $F_R$ (of the centrifugal force $F_C$ and the static weight of the body $F_G$) and the gravitational force $F_G$. This ensures that the line of the action of the resultant force $F_R$ remains perpendicular to the deck of the body portion. It also ensures that the occupants or passengers on the body portion do not experience the feeling of a centrifugal force acting in a direction oriented laterally relative to them and the body portion, parallel to the deck on which they are seated or standing and the level of liquid in a glass on a table for example, appears to the occupant or passenger to remain the same and not change angle relative to the table.

An additional advantage to making a coordinated turn is that the centre of mass of the body portion shifts inwards towards the centre of the turn relative to the hulls. Assuming that the centre of mass of the body portion is on the centreline of the vessel, assuming that the left and right halves of the vessel are mirrored through the centreline when the vessel is static, and assuming that the suspension geometry between the body portion and the hulls is the leading arm and slider type shown in FIG. 1 (so the hulls are constrained from moving in a direction parallel to the deck of the body portion and from rolling relative to the body portion), then for a right hand turn, the lateral shift of the body portion centre of mass towards the right provides an increase in vertical force on the right hull and an equal and opposite change (decrease) in vertical force on the left hull. Similarly a couple reacting the moment generated by the centrifugal force $F_C$ provides an increase in vertical force on the left hull and an equal and opposite change (decrease) in vertical force on the right hull. So for the example illustrated in FIG. 4 and described above, the change in vertical force on each hull due to the lateral shift of the body portion centre of mass is equal and opposite to the change in vertical force on each hull due to the couple reacting the moment generated by the centrifugal force. In this example therefore, the hulls do not experience any change in the vertical force exerted on them by the water (vertical relative to ground). The centrifugal force is also reacted by a horizontal force on each hull. The increase in magnitude of the resultant force $F_R$ over the magnitude of the gravitational force $F_G$ acting on the body portion also generates a corresponding increase in magnitude in the support forces in any springs or actuators supporting the body portion. Maintaining a substantially constant vertical force on each hull (vertical relative to ground) allows the hulls to continue to operate efficiently during a turn, making it easier to maintain speed during a coordinated turn compared to a turn where the body portion roll attitude $\varphi$ is not at the angle $\theta$ for a coordinated turn.

If an alternative suspension geometry (locating the hulls relative to the body portion) is used, the width between the hulls can change, the roll angle of the hulls relative to the body portion can change, the spacing between the centres of buoyancy of the left and right hulls can change and the transfer of forces and moments between the hulls and the body portion can change. This can generate an imbalance in the change in vertical loads on the hulls between reacting the moment of the centrifugal force versus reacting the lateral weight shift for example and this can result in various effects including roll jacking. It also means that different control strategies will either need to take suspension geometry effects into account (or approximately compensate for them) or will only adjust the roll attitude of the body portion of the vessel to an approximation of a coordinated turn where the roll angle of the body portion $\varphi$ is similar, but not exactly equal to the angle $\theta$ required for a coordinated turn as defined above. Such control strategies can optimse for efficiency (i.e. minimal change in the vertical load on each hull and hence minimised loss of speed during turning) or optimise for passenger comfort (i.e. a perfectly coordinated turn) or any desired compromise or balance between these strategies.

Figure 5:
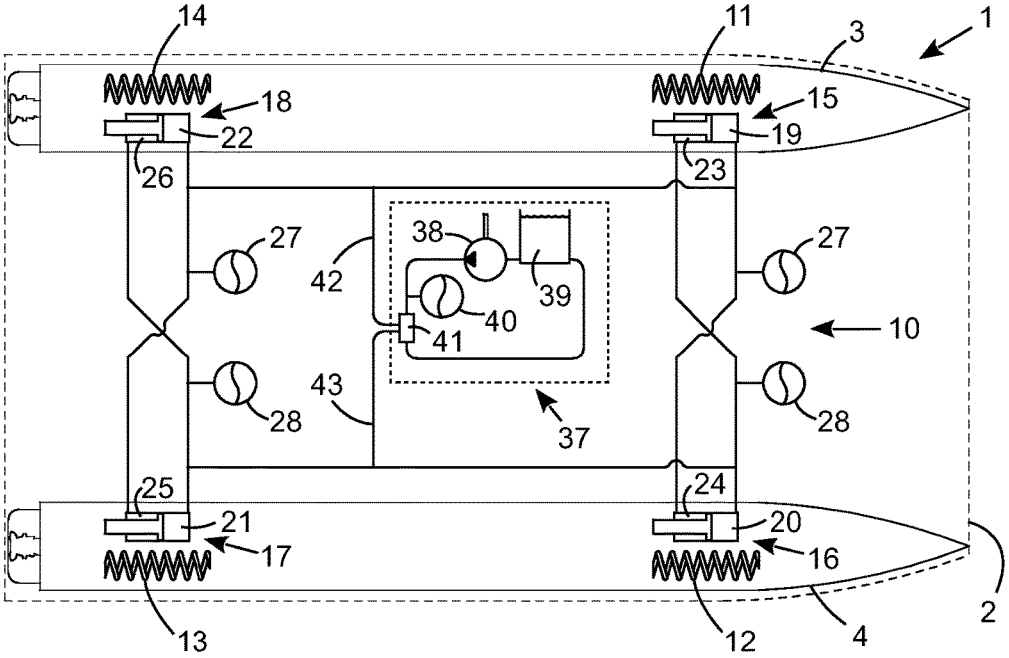
FIG. 5 is a schematic plan view of the vessel of FIG. 1.

FIG. 5 shows a possible suspension support arrangement 10 for a catamaran such as the vessel 1 in FIGS. 1 to 4. In this schematic view, the elements of the suspension system shown are the supports and related interconnections rather than any suspension linkages (such as the leading arm and sliding arrangement shown in FIG. 1) which are omitted for clarity. In this example the suspension support arrangement 10 includes an independent support spring 11, 12, 13 and 14 and an interconnected hydraulic ram 15, 16, 17, 18 at each front left, front right, back right and back left support points or locations. The front right support 6 in FIG. 1 comprises the spring 12 and ram 16 in this example and the rear sliding arm can house the spring 13 and ram 17. The front left compression chamber 19, back left compression chamber 22, front right rebound chamber 24 and back right rebound chamber 25 are connected to each other and to at least one fluid pressure accumulator 27 forming a left roll compression volume. Similarly the front right compression chamber 20, back right compression chamber 21, front left rebound chamber 23 and back left rebound chamber 26 are connected to each other and to at least one fluid pressure accumulator 28 forming a right roll compression volume. The roll attitude of the body portion 2 of the vessel can be adjusted by removing fluid from one roll compression volume and supplying fluid to the other roll compression volume, either effectively or actually. To this end a fluid control system 37 is shown including a pump 38, tank 39, supply accumulator 40, valve block 41 and control conduits 42 and 43.

The roll control system of the interconnected hydraulic rams provides roll stiffness without a corresponding stiffness in the warp mode. The rod cross sectional area influences the heave stiffness, the ratio of bore (compression) and annular (rebound, i.e. bore minus rod) area to rod area influences the ratio of roll to heave stiffness. So the hydraulic rams are modal supports when interconnected. Conversely the independent springs are independent supports, providing stiffness in all modes, roll, pitch heave and warp.

Figure 6:
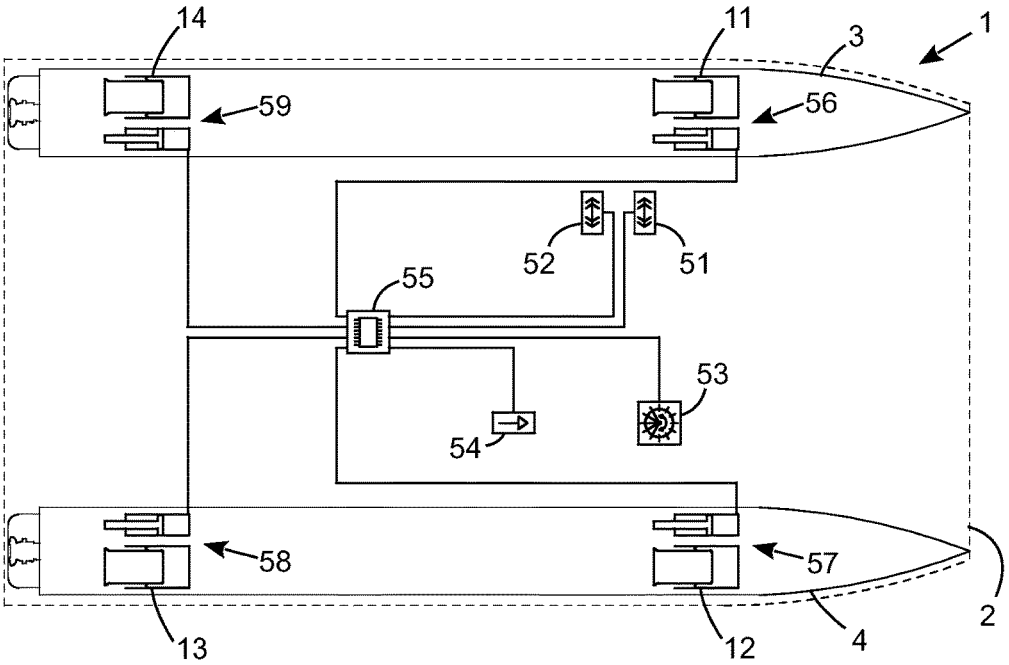
FIG. 6 is a schematic plan view of an alternative arrangement to FIG. 5.

FIG. 6 shows an alternate support arrangement and in this example, sensors and a control unit are also shown. The sensors and control unit would be present in other embodiments, but have been omitted from other drawings for clarity. The sensors shown in FIG. 6 are an upper and a lower lateral accelerometer 51, 52, a steering sensor 53 and a vessel speed sensor 54. The control unit 55 detects operating parameters from the sensors and determines an action. The sensors can also include global position, heading and suspension position, force and/or pressure. The springs 11, 12, 13, 14 are shown as air springs and they are preferably sized or designed to provide support with very low stiffness, so vary in force by for example less than twenty percent for a roll, pitch, heave or warp motion of the hulls 3, 4 relative to the body 2. The front left, front right, back right and back left actuators 56, 57, 58, and 59 are linear actuators such as electro-magnetic motor-generators, controlled by the control unit 55 to stabilise the height and attitude of the body 2. They can provide damping of relative motions between the hulls and the body and provide expansion or contraction forces to adjust the positions of the hulls relative to the body, so can for example adjust the roll attitude of the body to roll it inwards during cornering such as when performing a coordinated turn.

The suspension arrangements of FIGS. 5 and 6 support at four spaced apart points (two longitudinally spaced supports on the left hull and two longitudinally spaced supports on the right hull). They can therefore be applied to quadmarans having front and back left hulls and front and back right hulls.

Figure 7:
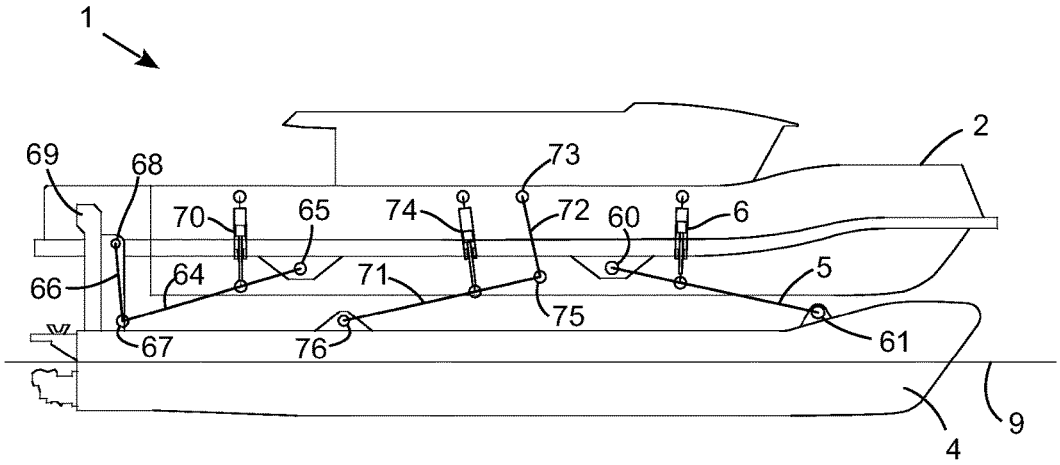
FIG. 7 is a side view of a multi-hulled vessel suitable for use with the present invention.
Figure 8:
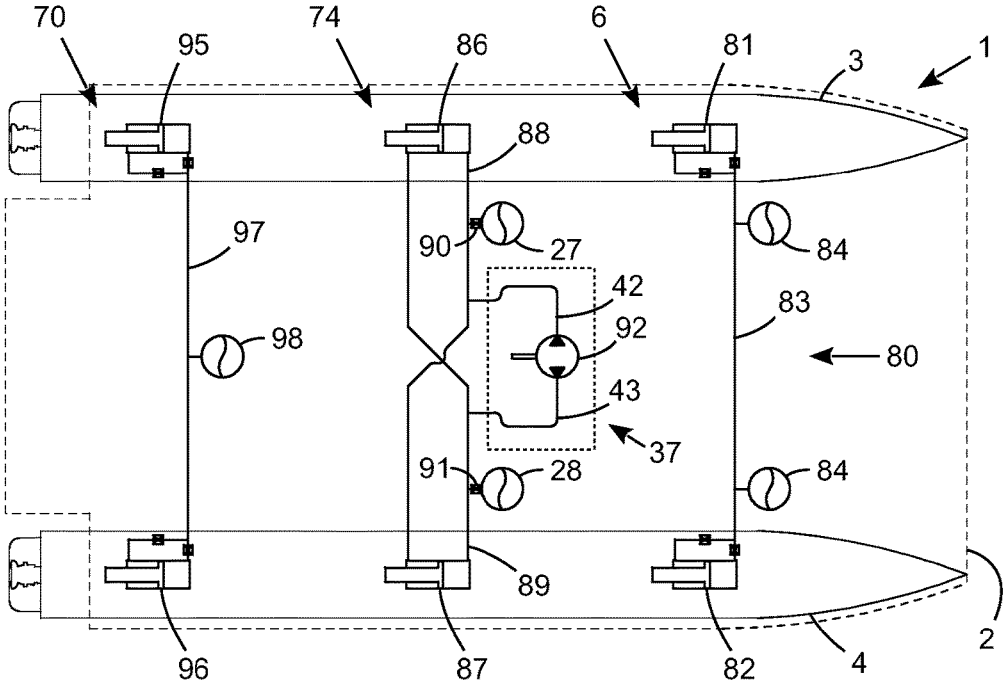
FIG. 8 is a schematic plan view of the vessel of FIG. 7.

The catamaran in FIG. 7 has three suspension support points or locations between each hull and the body, i.e. a total of six support points. This can be beneficial when the vessel is larger or to provide separation between the pitch, roll and warp modes using interconnections between supports as shown in FIG. 8. Referring initially to FIG. 7, the vessel 1 is similar to that in FIG. 1 having a body 2 suspended above hulls (again only the right hull 4 is visible in FIG. 7) by a suspension system including a front leading arm 5 and a front support 6. The front leading arm is pivotally connected to the body at body mount point 60 and to the hull 4 at front hull mount point 61 (for example by bushings) to provide lateral and some yaw location of the hull 4 relative to the body, constraining the front hull mount point 61 to follow an arc centred at body mount point 60. However an alternative rear suspension geometry is shown including a trailing arm 64 which is connected to the body at body mount point 65 and to a drop link 66 at knee joint 67. The drop link is in turn mounted to the hull 4 at back hull mount point 68 which is fixed to an up-stand ahead of the engine intake 69. Again the joints or mount points 65, 67 and 68 are preferably all of the pin type or bushings as the back arm arrangement (i.e. the rear suspension geometry) preferably provides lateral location of the hull relative to the body and at least some level of roll and yaw constraint on the hull relative to the body, but no other constraints. So together with the front leading arm, the hull position is constrained, but able to move in the pitch and heave directions relative to the body. The back support 70 acts between the body 4 and a point approximately one third of the way along the trailing arm 64 from the body end. This gives a lever ratio on the back support 70 increasing the load but significantly reducing the required stroke.

The mid arm 71 is hung from a drop link 72 connected at the top to a body mount point 73. A mid support 74 acts between the body and a point along the mid arm. The joints at the body mount point 73, knee joint 75 and mid hull mount point 76 can all have the same functionality as a ball joint, or one can be a pin type joint, but the mid arm is provided to give a lever ratio to the mid support 74 between the body and the hull without providing any suspension geometry type location of the hull relative the body. In this example all the of the rams are shown with a similar 3:1 lever ratio, although this can be adjusted to enable common bore sizes between all rams when sized for the same pressure range for example, to increase part commonality. Again, the line 9 indicates a typical waterline on the hull 4.

FIG. 8 shows one possible arrangement of supports for the vessel of FIG. 7. In this support arrangement 80, the front supports 6 comprise a front left support 81, a front right support 82, interconnecting conduit 83 and fluid pressure accumulators 84 and 85. The front left and right supports shown are effectively single-acting rams in their support action and double-acting rams in their damping action. Each support or ram has a conventional construction of cylinder bore and piston rod forming a compression and a rebound chamber, but the rebound chamber is in fluid communication with the compression chamber via restrictions or damper valves. A single-acting ram could be used, although that raises the possibility of drawing a vacuum in the compression chamber limiting the maximum rebound damping. The lateral conduit or pipe 83 provides fluid communication between the compression chambers of the front left and right rams which removes the roll stiffness provided by the front supports while still providing support in the heave and pitch modes of the suspension system. As damping is provided on or near each support or ram, no damping is shown on the fluid pressure accumulators.

Conversely the mid supports 74 comprise double-acting rams and interconnections. The mid left support or ram 86 has its compression chamber connected to the rebound chamber of the mid right support or ram 87 by a cross-connecting conduit 88 forming a left roll compression volume which also includes left roll fluid pressure accumulator 27. Similarly the mid right support or ram 87 has its compression chamber connected to the rebound chamber of the mid left support or ram 86 by a cross-connecting conduit 89 forming a right roll compression volume which also includes right roll fluid pressure accumulator 28. In this case damper valves 90, 91 are shown between the fluid pressure accumulators and the remainder of each compression volume which can be beneficial as this location provides a higher roll damping force than heave damping force in the mid supports and also, when active roll control is provided, damping of the roll resilience improves system response and controllability.

To enable active control of the roll attitude, to achieve a coordinated turn for example, again a fluid control system 37 is used. In this example, the fluid control system 37 comprises a bi-directional pump 92 connected to the left and right compression volumes by conduits 42 and 43. A valve can be provided in-line with the pump 92 to ensure that fluid does not flow between the roll compression volumes when no roll adjustment is intended. This arrangement allows a straightforward transfer of fluid between the left and right roll compression volumes. Conversely the arrangement of fluid control system shown in FIG. 5 including a pump, tank, valve block and optional supply accumulator controls the pressure individually in the left and right roll compression volumes, letting fluid out of one volume and pumping fluid into the other volume rather than directly transferring fluid between roll compression volumes.

The back supports 70 are in this example the same as the front supports 6, i.e. the back supports comprise a back left support 95, a back right support 96 and interconnecting conduit 97 although only one fluid pressure accumulator 98 is present as it can be used by both the left and the right supports. Alternatively the back supports can be independent and/or incorporate additional roll rams cross-connected like the mid supports providing additional left and right roll compression volumes which can be connected to the left and right roll compression volumes of the mid supports.

If the mid support rams 86 and 87 (i.e. the roll rams) had rods that extended through the compression chamber as well as the rebound chamber (through rods) then the mid support rams would be able to provide roll forces without providing heave forces. Alternatively, to achieve that same zero heave stiffness functionality, the mid support arrangement of FIG. 8 (the mid arm 71, drop link 72 and mid support 74) could be replaced by an anti-roll bar arrangement between the body and the left and right hulls 3 and 4. The anti roll bar can be mounted to the body and split into two halves connected by a rotary type roll actuator, or use a single piece bar with one of the drop links between the ends of the bar and the hulls can be a linear type roll actuator. Other arrangements of adjustable anti-roll bar are well known and could also be used. The roll actuator can be elector-mechanical or hydraulic and can be controlled by a control unit in dependence on signals from sensors such as those previously discussed.

All of the above examples have been described using variations on leading and trailing arm geometry which maintains a constant width between the hulls measured relative to the body, through heave and roll motions. However as discussed in relation to FIG. 4, if an alternative suspension geometry (locating the hulls relative to the body portion) is used, the width between the hulls can change, the roll angle of the hulls relative to the body portion can change, the spacing between the centres of buoyancy of the left and right hulls can change and the transfer of forces and moments between the hulls and the body portion can change.

Figure 9:
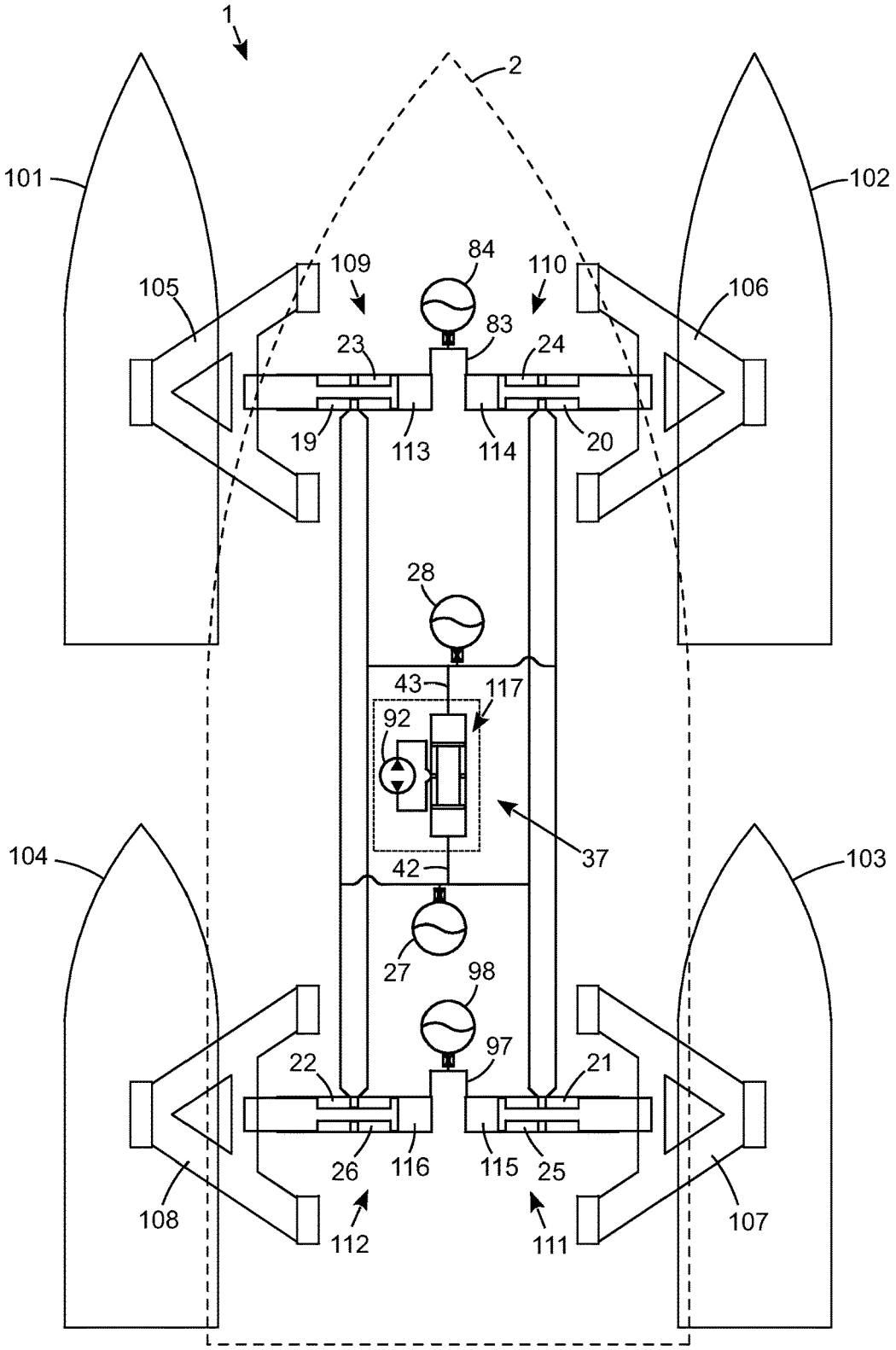
FIG. 9 is a schematic plan view of a vessel according to an embodiment of the present invention.

An example of an alternative suspension geometry is substantially laterally oriented wishbones as shown in plan view on the vessel in FIG. 9. This example shows a quadmaran with four hulls 101, 102, 103, 104 in an approximately rectangular configuration relative to the body portion 2 and the supports are fluid actuators such as hydraulic rams, although as discussed in relation to FIGS. 5 and 6 other suspension systems providing four points of support can be interchanged. Although the body can still be rolled relative to the hulls (ie relative to the water surface) by displacing the left and right hulls in a direction oriented vertically relative to the body (such as by moving the left hulls upwards relative to the body and the right hulls downwards relative to the body, or by moving the left hulls downwards relative to the body and the right hulls upwards relative to the body), the hulls move laterally relative to the body, due to the arc defined by the wishbones.

In this hydraulic actuator example, a front left ram 109 helps to provide support of the body portion 2 above the front left hull 101 via the front left wishbone 105. Similarly a front right ram 110 helps to provide support of the body portion 2 above the front right hull 102 via the front right wishbone 106, a back right ram 111 helps to provide support of the body portion 2 above the back right hull 103 via the back right wishbone 107, and a back left ram 112 helps to provide support of the body portion 2 above the back left hull 104 via the back left wishbone 108. Preferably an additional wishbone or other means of providing roll positioning is provided for each individual hull to control the rotation of the respective hull about its respective (longitudinal) roll axis relative to the body portion.

One possible arrangement of hydraulic interconnection between the rams is also shown in FIG. 9. Other arrangements are known, for example from the Applicant's International Application Numbers WO 2011/143692 and WO 2011/143694, details of which are incorporated herein by reference. In FIG. 9, each ram 109, 110, 111, 112 has three chambers. The first chambers 113, 114 of the front rams 109, 110 are interconnected providing heave and pitch support without providing a roll or warp stiffness. A fluid pressure accumulator is shown 84 on the conduit 83 to provide heave and pitch resilience as with the interconnected rams in FIG. 8. The first chambers 115, 116 of the back rams 111, 112 are similarly laterally interconnected by a conduit 97 having an accumulator 98. The second chambers 23, 26 of the left rams 109, 112 are left roll rebound chambers and are connected to each other and to the third chambers 20, 21 of the right rams 110, 111, which are right roll compression chambers, forming a right roll volume which increases in pressure as a roll moment is applied to the body portion that rolls the vessel to the right. The third chambers 19, 22 of the left rams 109, 112 are left roll compression chambers and are connected to each other and to the second chambers 24, 25 of the right rams 110, 111, which are right roll rebound chambers forming a left roll volume which increases in pressure as a roll moment is applied to the body portion that rolls the vessel to the left. Fluid pressure accumulators 27, 28 can be added to (i.e. placed in fluid communication with) the left and right roll volumes to add resilience in the roll mode. As with the previously discussed roll arrangements, the roll attitude of the body portion can be adjusted by driving fluid between the roll volumes using a fluid control system 37. In this example, the fluid control system 37 comprises a displacer unit 117 driven by the bi-directional pump 92 to effectively transfer fluid between the left and right roll volumes via the conduits 42, 43. As discussed in the Applicant's previously referenced International Application Numbers WO 2011/143692 and WO 2011/143694, the displacer unit typically provides left and right roll compression volume chambers that are larger than the left and right control chambers to which the pump is connected. This enables a small volume of high pressure fluid moved by the pump to generate a larger volume displacement of fluid between the left and right roll compression volumes, but at a lower pressure differential.

Figure 10:
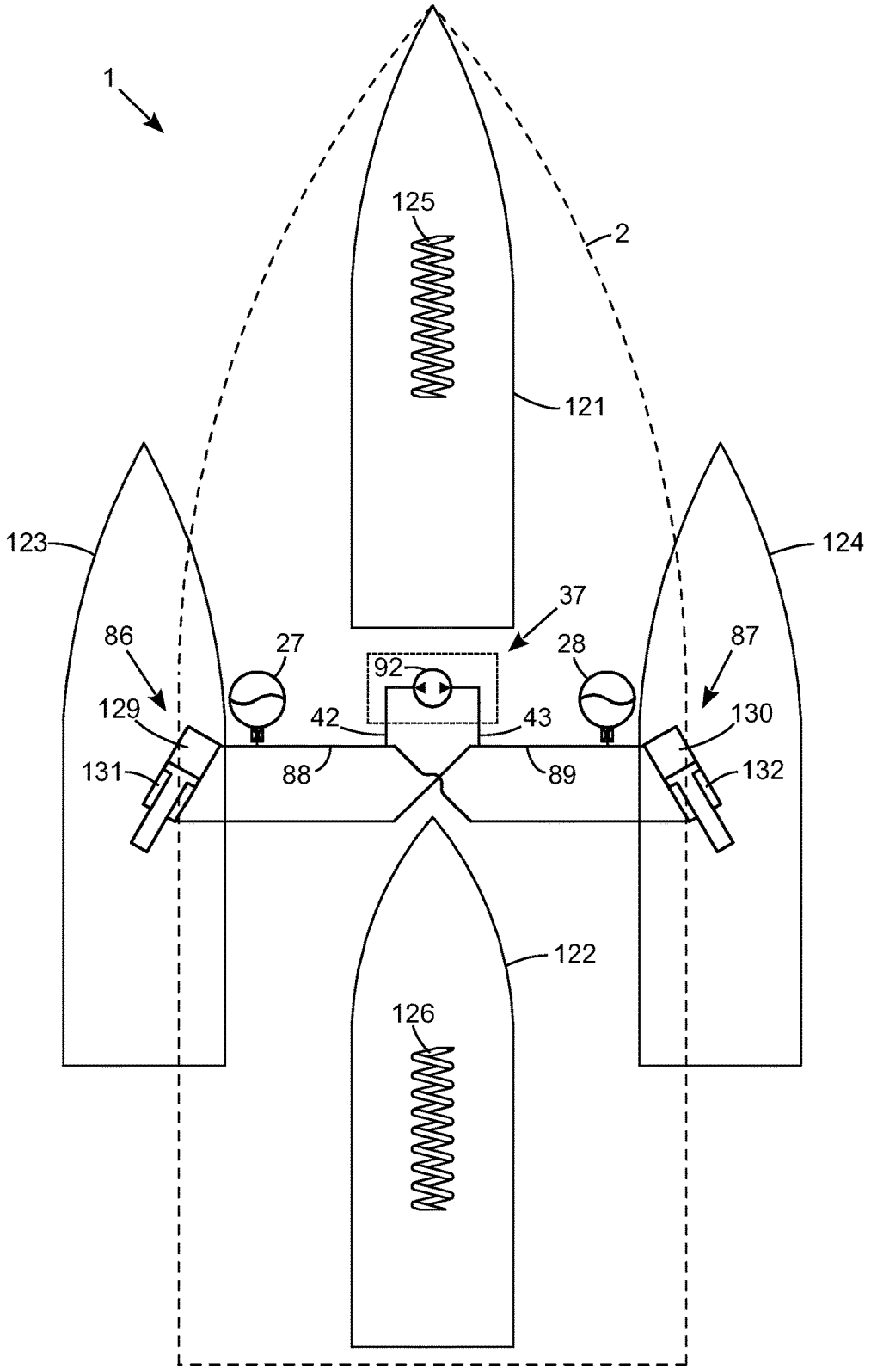
FIG. 10 is a schematic plan view of a vessel according to an embodiment of the present invention.

Another possible arrangement of supports and hulls is shown in FIG. 10 where four hulls of an alternate quadmaran are arranged in a diamond configuration, i.e. a front hull 121, a back hull 122, a left hull 123 and a right hull 124. In this example the supports between the body portion 2 and the respective front and back hulls are independent (i.e. not interconnected) springs such as coil springs 125, 126 with dampers (not shown) as this embodiment is not detailing pitch control (although interconnected springs are envisaged as previously disclosed in the Applicant's aforementioned International Applications). As with the mid rams in FIG. 8, the left and right rams 86, 87 (between the body portion 2 and the respective hulls 123, 124) provide a ratio of heave to roll stiffness determined by the ratio of over-piston minus under-piston area to over-piston plus under-piston area when cross-connected to form a left and a right roll volume. The left roll volume includes the compression chamber 129 of the left ram 86, the rebound chamber 132 of the right ram 87, the interconnecting fluid conduit 88 and the fluid chambers of the left roll accumulator 27. The right roll volume includes the compression chamber 130 of the right ram 87, the rebound chamber 131 of the left ram 86, the interconnecting fluid conduit 89 and the fluid chambers of the right roll accumulator 28. To provide adjustment of the roll attitude, the fluid control system 37 is provided between the left and right roll volumes.

Control of the roll attitude of the vessel can utilise a variety of inputs and produce differing results depending on the inputs chosen and the suspension geometry of the vessel. For example, if the lateral acceleration (in a direction parallel to the deck of the body portion) is measured during a perfectly coordinated turn it will be zero, so the control could use a body mounted lateral acceleration signal (which rotates with the body) and attempt to minimise that signal. However wave inputs accelerating the body could also generate a lateral acceleration signal from a single body-mounted lateral accelerometer. To overcome this, a pair of vertically spaced lateral accelerometers can be utilised, as shown schematically in FIG. 6 the average lateral acceleration measured by this pair of body mounted lateral accelerometers being the lateral acceleration felt by the passengers, oriented parallel to the deck. The difference between the lateral acceleration measured by these two body-mounted lateral accelerometers being an angular (roll) acceleration caused by the waves, so the coordinated turn control can ensure that roll motions of the body caused by wave inputs do not generate unnecessary control signals.

Alternatively or additionally the actual centrifugal force $F_C$ and the gravitational force $F_G$ can be measured (for example using gyro-stabilised accelerometers or a set of accelerometers which include compensation for rotation of the accelerometers relative to the ground or other reference frame), then the angle $\theta$ of the resultant force can be calculated and the angle $\Phi$ of the body portion adjusted to be equal (to $\theta$) as shown in FIG. 4.

Similarly the loads on the suspension supports, the pressures in any fluid actuators and/or the hull-to-body or actuator positions can be measured to prevent excessive adjustments being made, for example to ensure that all roll attitude adjustments are made within suspension travel limits and/or hydraulic system pressure limits. Similarly other limits can be incorporated into the control such as only providing a coordinated turn up to a preset lateral acceleration, beyond which the roll angle can either be maintained at the angle corresponding to that lateral acceleration, or rolled to an amount that is less than a perfectly coordinated turn, to give feedback to the pilot of the vessel that cornering acceleration is high.

In each of the preceding cases, measuring acceleration or suspension loads, the centrifugal force must already be acting for the acceleration or load changes to be detected, but for the centrifugal force or roll loads to be present, the roll attitude of the vessel will typically have already started to move, potentially in the opposite direction to the aim for roll angle of the body portion during a coordinated turn. To reduce or eliminate this phase lag, it is preferable to measure a steering angle (rudder and/or propulsion thrust direction) and vessel speed to calculate or predict the centrifugal force and enable the control of the roll attitude of the body portion to be commenced prior to significant lateral acceleration (due to centrifugal force) building. As the steering angle can be changed faster than the boat will respond in roll, a function of time can be incorporated to control and/or limit the rate of change of roll attitude of the body portion. This is not only beneficial to occupant comfort, but is useful to prevent overshoot of roll angle changes.

A further benefit of including steering and speed inputs into the control of the roll attitude for a coordinated turn is one of low control forces and energy input. If a fluid suspension arrangement is providing all of the roll stiffness of the suspension system between the body portion and the hulls, and assuming that the vessel is balanced left to right in an ideal case, then the pressure difference between the left and right roll volumes will be zero statically. Also if the roll attitude of the body portion is continually adjusted so that the change in vertical force on each hull due to the lateral shift of the body portion centre of mass is equal and opposite to the change in vertical force on each hull due to the couple reacting the roll moment generated by the centrifugal force, then the pressure difference between the left and right roll volumes will remain minimal. Therefore to adjust the roll attitude of the vessel, sufficient pressure is required to create the desired rate of change of roll attitude of the body, i.e. to overcome rotational inertia, but additional pressure is not then required to compensate for the roll moment generated by the centrifugal force (due to the roll moment generated by the lateral shift of the body portion centre of mass) since this is minimised.

Figure 11:
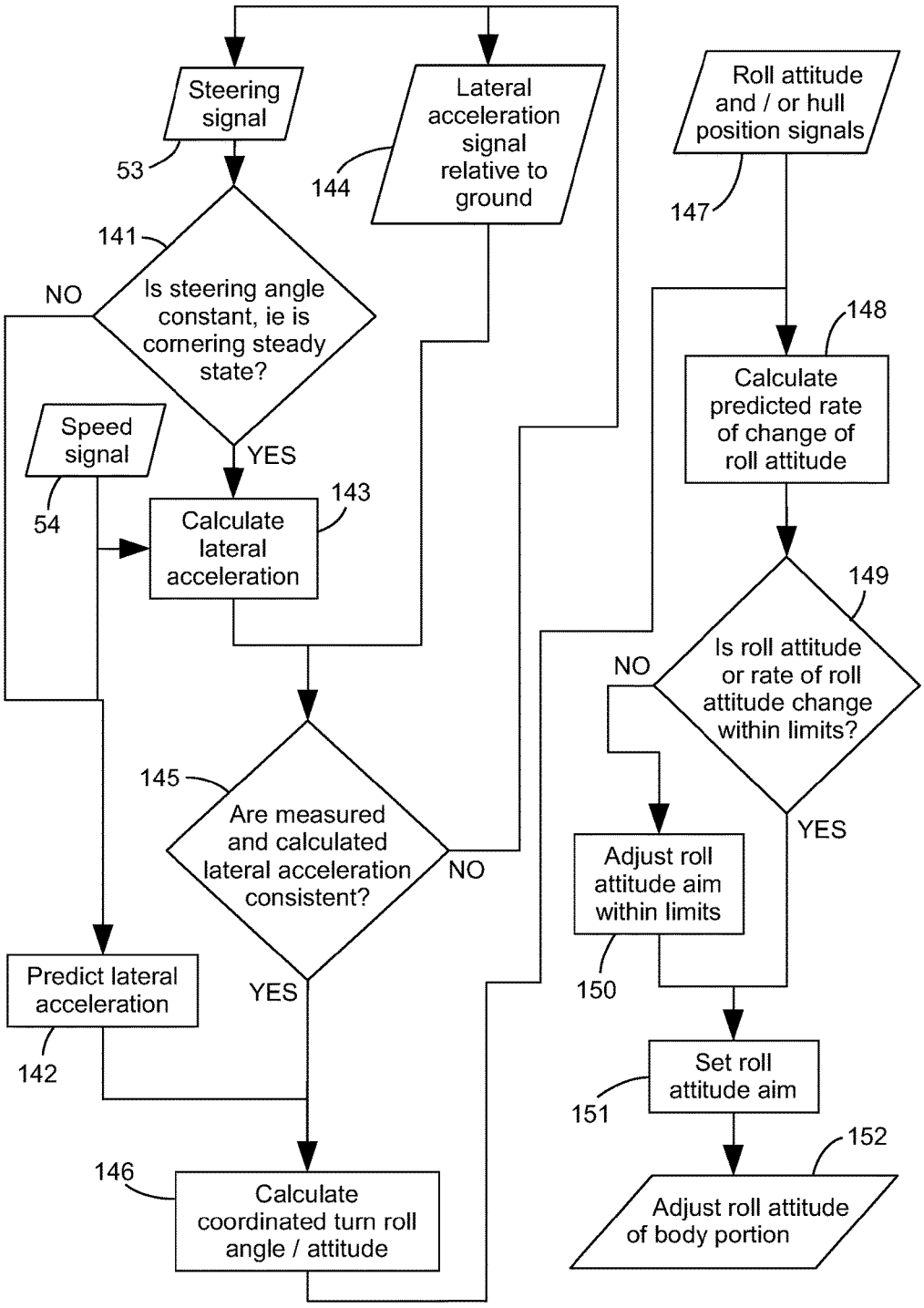
FIG. 11 is a flow chart of a control method according to an embodiment of the present invention.

A simplified control flow diagram is shown in FIG. 11. In this example, the loads in the suspension supports have not been included, the primary inputs being speed 54 and steering angle 53 which are used to calculate or predict lateral acceleration, the preferable primary parameter for coordinated turn control. If the steering angle is constant, then steering angle and lateral acceleration can be used to determine lateral acceleration, so change in steering angle is assessed at 141. If steering angle 53 is changing then it can be used with vessel speed 54 to predict lateral acceleration at 142. This enables the controlled roll attitude of the vessel to start to move towards the ideal coordinated turn position as soon as an input that will result in lateral acceleration is received, but before the hulls have reached the corresponding yaw rate, hence before the corresponding lateral acceleration and roll moment is generated, so the energy required to roll the vessel is minimised. Conversely if at 141 steering angle is steady state, then the speed signal 54 can be used with steering angle 53 to calculate lateral acceleration at 143. Lateral acceleration is also input, in this case from a tri-axial linear accelerometer 144 which outputs lateral acceleration measured parallel to ground rather than oriented relative to the body. This lateral acceleration 144 can be compared at 145 to the calculated lateral acceleration from 143 either to verify a roll attitude control output (directionally at least) or in this case to verify the calculated lateral acceleration from 143 and either re-start sampling or continue onwards to calculate the coordinated turn roll angle or roll attitude adjustment direction and magnitude in 146 based one of the more of the lateral acceleration parameters (predicted 142, calculated 143 and measured 144).

In this example, the calculated or predicted lateral acceleration is used to calculate the corresponding roll attitude for a perfectly coordinated turn. This assumes that the lateral acceleration is absolute, ie relative to ground, not relative to the body of the vessel. Alternatively, if the lateral acceleration is only taken from one or more lateral accelerometers that are mounted on the body, then the lateral acceleration is measured using a reference frame that is relative to the body. Therefore then minimising the lateral acceleration should keep the vessel roll attitude in a coordinated turn attitude where the sum of the gravitational force and the centrifugal force acting on the vessel during a turn is perpendicular to the deck of the vessel. In this case it is preferable to use two vertically spaced lateral accelerometers, then average the detected accelerations to separate the lateral acceleration on the body (oriented laterally with respect to the body) from any roll accelerations on the body.

Returning to FIG. 11, the current (i.e. instantaneous) roll attitude or hull position signals are input at 147 to allow rate of change limitation or limit stops to be implemented. This can be done by calculating a predicted roll angle and predicted rate of change of roll angle during a short forward time window in 148 and comparing it at 149 to travel limits of the rams, suspension or other limits including virtual limits set in the control software to protect the system, vessel and occupants. If the predicted roll angle is not within the limits set, then the roll attitude aim is adjusted at 150 from a perfectly coordinated turn to an acceptable roll attitude aim then fed to the register at 151 setting the roll attitude aim to be actuated at 152. Conversely if the roll attitude aim is within the preset limits, then the desired roll attitude is fed to the register at 151 and actuated at 152 by outputting appropriate control signals. These control signals can be hydraulic pump and valve control signals, or signals to control the direction and magnitude of force in an electromagnetic actuator for example.

If the hull positions relative to the body are not input, then at 146 instead of calculating a roll angle or roll attitude change, a parameter relating to direction of roll angle adjustment and preferably also to magnitude of change required, can be determined and passed directly to 152 to generate control signals which adjust the roll attitude of the vessel body. The control signals can for example, in the case of the hydraulic control system 37 of FIG. 5, be valve control signals to control the valves 41, although roll compression volume pressures need to be known, or in the case of the hydraulic control system 37 of FIGS. 8, 9 and 10, the control signals can be motor direction and speed control only. In the case of an electro-mechanical actuator as in FIG. 6, the control signals can be actuator force and/or position.

Figure 12:
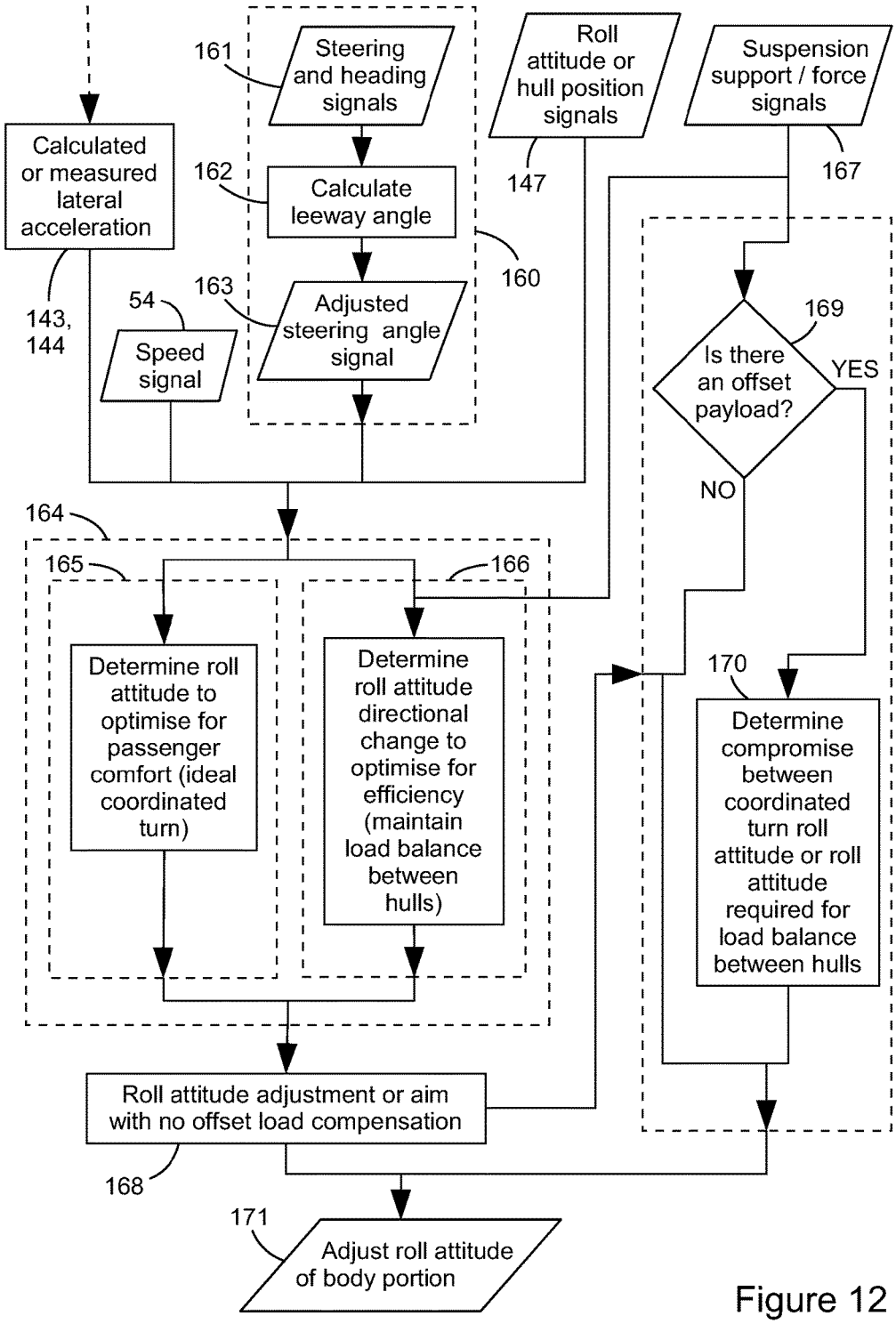
FIG. 12 is a flow chart of an adapted or alternative control method according to an embodiment of the present invention.

FIG. 12 shows alternative elements of a coordinated control. Many of these elements, or at least several of the blocks can be used in combination with the processes described in FIG. 11. When cross-winds are present, i.e. when the vessel is proceed with a leeway angle, additional complexities can arise. For example if the steering (by propulsion or rudder) is turned to compensate for windage and maintain a straight course in a cross-wind, a rolling moment is generated on the vessel by the turning force in the water, which in turn can cause a roll of the deck of the body portion. If the control of the deck attitude is primarily driven by accelerometers mounted to the body to try to maintain zero lateral acceleration measured parallel to the deck, then when the vessel is travelling in a straight line with a cross wind, the deck will maintained level, but the force balance between the left and right hulls will not be maintained as the steering is moved away from zero (straight ahead). Conversely if the control of the deck attitude is primarily driven by a function of steering angle and speed, then when the vessel is travelling in a straight line with a cross wind, the deck will be rolled to compensate for a lateral acceleration (or centrifugal force) predicted from steering angle and speed, so will not be level although the vessel is travelling in a straight line, but the approximate force balance between the left and right hulls will be maintained. Ideally any control, controller, control system, control algorithm or function uses both measured lateral acceleration (from one or more lateral accelerometers) and predicted lateral acceleration (from a function of speed and steering angle for example) to arrive at the desired compromise or balance between the occupants feeling no lateral acceleration and maintaining the force balance between the left and right hulls. When travelling in a steady path a Global Positioning System signal can be used to detect and confirm that the vessel is proceeding with a leeway angle (instead of or in combination with one or more of the above options). Block 160 contains a routine to ensure that the steering angle input to the rest of the control system is compensated for leeway angle. As leeway angle can generate uneven loads between the left and right hulls it can optionally also be used when assessing support loads. In 160 the steering signal or a heading signal together with a displacement vector from a global positioning system 161 can be used to calculate the leeway angle 162 and an adjusted steering signal 163 can then be output.

The calculated or predicted lateral acceleration 143, 144 and/or the adjusted (ie leeway compensated) steering angle 160 together with speed 54 can then be used in 164 to determine the roll angle for a coordinated turn following the possible path 165. Alternatively, if suspension support force signals 167 (or pressures or other signals indicative of support forces) are also input, then at 164 the alternative path in 166 can be followed and the roll attitude determined to optimise efficiency and/or maintain the load balance between the left and right hulls. Where load change on the hulls is primarily due to lateral acceleration and the payload does not move significantly, the suspension forces can be used to calculate lateral acceleration. In this case, the lateral acceleration and hull position signals are not essential, but can be used as a check to ensure that a load-based adjustment is not causing a significant roll angle difference to a coordinated turn (say less than three or four degrees for example). The control unit for the suspension system can use either of the coordinated turn or load optimised paths in calculating block 164 or even a combination of the two which could be selected by the pilot or determined automatically depending on operating conditions such as sea state and/or speed. For example if the vessel is not planing it can be preferable to optimise for a coordinated turn, but when at planing speeds, it can be preferable to optimise for load balance to ensure efficiency and that the vessel continues to plane while cornering.

After the calculating block 164 the roll attitude adjustment or aim 168 is set, either for a perfectly coordinated turn, or to maintain the load balance between or minimise a load difference between the left and right hulls, or a combination of the two so the roll attitude is between the angle for a coordinated turn and the angle for load balance. However, the suspension support force or equivalent signals 167 can at 169 also be used to determine if there is an uneven load between the left and right hulls due, for example, to an offset load or payload on the body. If not the roll attitude adjustment from 168 can be passed directly to the output signals of 171 to effect adjustment of the roll attitude of the body relative to the hulls. If however at 169 it is determined that there is an offset load on the body portion, then again the balance or compromise between coordinated turn and balanced hull loads can be determined at 170 before the control unit outputs roll attitude adjustment signals at 171, particularly if, in the initial roll attitude determination in 164, the coordinated turn path 165 was followed without taking suspension loads from 167 into account.

If there is a lateral shift of the load on the deck (i.e. if many passengers go to one side of the vessel to look at something or if a load is added, moved or removed), while using a body mounted lateral accelerometer will enable the deck to be controlled to maintain a level position, the load balance between the left and right hulls changes, which may affect efficiency. Conversely if the control of the attitude of the deck and body is primarily driven by the forces and/or pressures in the left and right support devices, the body will be rolled upwards on the side where the load is greater, but the balance between the hull loads will be maintained during the load shift. Therefore it can be beneficial to use both functions (including measured, calculated or predicted lateral acceleration or support device loads or pressures) to arrive at the desired balance between the occupants feeling no lateral acceleration and maintaining the force balance between the left and right hulls. So any control strategy can use any or all of: lateral acceleration; speed and steering angle; and support loads or pressures, or other parameters enabling the prediction of lateral acceleration.

An offset can be used as a variable that changes at a lower frequency than the sensor scanning rate and can be used to adapt the control of the roll attitude. One such example would be the leeway angle in 160, and as parameters such as the vessel heading or the wind direction change, the offset can be updated. Similarly an offset can be used to adapt the control of the roll attitude for load offsets as detected at 167 and updated as the load shifts. To prevent sudden or unnecessary changes in such an offset which could generate unwanted and potentially abrupt changes in roll attitude (angle of the body portion) the rate of change of the offset can be limited, such as a decay function based on time and potentially other inputs such as the initial magnitude of the offset, lateral acceleration, speed, steering angle and/or at least one load on at least one hull or at least one suspension member such as a ram.

Similarly the rate of change of roll attitude aim or roll attitude adjustment magnitude can be limited to effectively damp the control to provide a more comfortable ride on the vessel body and/or to increase efficiency by effectively smoothing the control output signals.

The invention can be applied to any multi-hulled vessel where at least two hulls move relative to each other. Although previous inventions have enabled mono-hull vessels to make coordinated turns for passenger comfort and stability reasons, they have had to use interceptors, ailerons or other flaps or wings to drive the change in roll angle. These all require continued loss of power through drag or equivalent resistances to provide the forces that are adjusting the roll angle of the vessel from its natural inclination. The advantages of the present invention are unique to multi-hulled vessels in which the attitude of the body portion can be rolled and primarily relate to reduced power consumption or increased efficiency. For example if the roll attitude adjustment system includes a hydraulic system, then once the roll attitude of the body portion has been adjusted to an angle corresponding to a coordinated turn (i.e. the resultant of the gravitational and centrifugal forces acts perpendicular to the deck), then typically no power is required to maintain it there.

There are many possible forms of adjustment means for taking fluid from one of conduits 42, 43 (connected to the respective roll volumes) and supplying it to the other of said conduits, as shown by the variety of fluid control systems 37 in the Figures.

The suspension system can be of any type that allows adjustment of the roll attitude, so need not be hydraulic system based with powered roll attitude adjustment and can alternatively include motor-generators, for example in the form of linear actuators as discussed in the Applicant's U.S. Pat. No. 7,314,014 and in relation to FIG. 6. In this case, the supports typically include coil springs, air springs, torsion bars and other known forms of resilient support in addition to or integrated with the linear actuators. The resilient supports are required to support the mass of the body statically, with the motor generators providing damping loads and also forces to deflect the support from the static support position. This has the disadvantage that continuous power is required to hold the supports in positions away from the static support position, even when for example in a steady state turn, so the resilient supports are ideally very low in stiffness.

The body portion of the vessel may engage the water surface, i.e. the body portion may include an additional hull. For example in the case where a single left hull and a single right hull is utilised, if the body is entirely suspended above the left and right hulls and not engaging with the water as shown in FIGS. 1 to 4, the vessel would be a catamaran, but if the body includes an additional hull engaging the water, the vessel would be a trimaran.

Modifications and variations as would be apparent to a skilled addressee are deemed to be within the scope of the present invention.

The invention claimed is:

1. A vessel having a body portion that is at least partially suspended above at least one left moveable hull and at least one right moveable hull, each moveable hull being moveable with respect to the body portion, at least one sensor arranged to sense at least one operational parameter of the vessel, and a controller configured to control a roll attitude of the body portion by causing the orientation of the body portion of the vessel relative to the hulls to change, the roll attitude of the body portion being adjustable and controlled during operation in response to said at least one operational parameter to ensure that the sum of the gravitational force and the centrifugal force acting on the vessel during a turn has a line of action that is substantially perpendicular to a deck of the vessel, wherein the at least one operational parameter includes at least one lateral acceleration parameter.

2. A vessel as claimed in claim 1 wherein the at least one lateral acceleration parameter includes a predicted lateral acceleration, being a function of steering angle and speed.

3. A vessel as claimed in claim 1 wherein the at least one lateral acceleration parameter includes a calculated lateral acceleration, being a function of steering angle and speed.

4. A vessel as claimed in claim 1 wherein the at least one lateral acceleration parameter includes a calculated lateral acceleration, being a function of suspension support forces.

5. A vessel as claimed in claim 1 wherein the at least one lateral acceleration parameter includes a measured lateral acceleration, being measured in a lateral direction oriented horizontally with respect to the body portion.

6. A vessel as claimed in claim 1 wherein the at least one lateral acceleration parameter includes a measured lateral acceleration, being measured in a lateral direction relative to ground.

7. A vessel as claimed in claim 1 wherein the body portion is entirely supported above said at least one left moveable hull and at least one right moveable hull.

8. A vessel as claimed in claim 1 wherein the body portion of vessel additionally includes at least one fixed hull, fixed to the body portion and providing partial support of the body portion relative to the water surface.

9. A vessel as claimed in claim 1 wherein the at least one left moveable hull is a single hull disposed at a left side of the vessel and the at least one right moveable hull is a single hull disposed at a right side of the vessel.

10. A vessel as claimed in claim 1 wherein the at least one left moveable hull includes a forward left hull and a rearward left hull and the at least one right moveable hull includes a forward right hull and a rearward right hull.

11. A vessel as claimed in claim 1 wherein the body is entirely suspended above said at least two hulls which are individually moveable relative to the body in a vertical direction, but constrained from moving in a lateral direction oriented horizontally relative to the body, the balance of load between each hull being substantially maintained during a coordinated turn.

12. A vessel as claimed in claim 1 wherein the control of the roll attitude of the body portion includes time or wherein the at least one operational parameter is time-averaged.

13. A vessel as claimed in claim 1 wherein the body portion is supported above the hulls by a suspension system including multiple support devices, the control of the roll attitude of the body portion using pressures within at least one of said multiple support devices.

14. A vessel as claimed in claim 1 wherein the body portion is supported above the hulls by a suspension system including multiple support devices, the roll attitude of the body portion being controlled up to a roll attitude limit which is determined in dependence on at least one support device exceeding a predefined travel limit.

15. A vessel as claimed in claim 1 wherein the roll attitude of the body portion is controlled up to a roll attitude limit which is determined in dependence on hull displacement relative to the body portion and/or a detected sea state.

16. A vessel as claimed in claim 1 wherein the body portion is supported above the hulls by a suspension system including multiple support devices, the control of the roll attitude of the body portion using loads upon at least one of said multiple support devices.

17. A vessel as claimed in claim 1 wherein the body portion is supported above the hulls by a suspension system including multiple support devices, the roll attitude of the body portion being controlled up to a roll attitude limit which is determined in dependence on at least one support device exceeding a predefined pressure or load.

18. A vessel as claimed in claim 1 wherein the roll attitude of the body portion is controlled up to a roll attitude limit which is determined in dependence on a detected sea state.

19. A method of controlling the roll angle of a body portion of a vessel, the vessel further including at least two hulls moveable relative to the body portion, the body portion being at least partially supported above said at least two hulls, the method including the steps of detecting at least one lateral acceleration parameter and controlling a roll angle of the body portion relative to the movable hulls by causing the orientation of the body portion of the vessel relative to the hulls to change using the at least one lateral acceleration parameter to ensure that the line of action of the sum of the gravitational force and the centrifugal force acting on the vessel during a turn is substantially perpendicular to a deck of the vessel.

20. A method according to claim 19 wherein the step of detecting the lateral acceleration of the body portion uses at least one lateral accelerometer mounted to the body portion.

21. A method according to claim 19 wherein the step of detecting at least one lateral acceleration parameter includes the steps of measuring vessel operating parameters and calculating or predicting turning forces on the body portion.

22. A method according to claim 21 wherein the operating parameters include vessel speed & steering angle.

23. A method according the claim 19 wherein the step of adjusting the roll angle of the body using the at least one lateral acceleration parameter includes the step of adjusting the roll angle of the body to ensure that at least a vertical component of the pressure loads on the at least one left hull is within 15% of the equivalent at least vertical component of the pressure loads on the at least one right hull.

24. A method according to claim 23 wherein the vessel further includes a suspension system for supporting at least a portion of the body above or relative to the at least one left hull and one right hull, the method further including the step of estimating or measuring at least one load on or at least one pressure in the suspension system.

25. A method according to claim 19 further including the steps of:

determining the leeway angle with which the vessel is proceeding; and calculating a roll angle offset to reduce or remove any difference between a roll angle set point for a perfectly coordinated turn and a roll angle set point calculated using inputs influenced by the leeway angle.

26. A method according to claim 25 wherein the magnitude of the roll angle offset is decayed over time.

27. A method according to claim 19 further including the steps of:

determining a magnitude of payload offset; and calculating a roll angle offset to reduce or remove any difference between a roll angle set point for a perfectly coordinated turn and a roll angle set point calculated using inputs influenced by the magnitude of payload offset.

28. A method according to claim 27 wherein the magnitude of the roll angle offset is decayed with time.

* * * * *